United States Patent [19]

Tapper

[11] 4,363,335

[45] Dec. 14, 1982

[54] GUTTER CLEANER

[76] Inventor: William R. Tapper, 3935 Walden La., Wayzata, Minn. 55391

[21] Appl. No.: 265,855

[22] Filed: May 21, 1981

[51] Int. Cl.[3] ..... B08B 9/00

[52] U.S. Cl. ..... 134/167 C; 15/406

[58] Field of Search ..... 134/167 C, 166 C, 168 C; 15/236 R, 160, 406; 401/9, 137

[56] References Cited

U.S. PATENT DOCUMENTS

| | | | |
|---|---|---|---|
| 2,710,616 | 6/1955 | Tydings | 15/406 X |
| 2,896,239 | 7/1959 | Bugbird | 15/236 R X |
| 3,601,835 | 8/1971 | Morgan | 15/105 |
| 3,751,749 | 8/1973 | Wilson | 15/23 X |
| 4,121,320 | 10/1978 | Feiner | 15/406 |
| 4,238,866 | 12/1980 | Taylor | 15/23 |
| 4,304,498 | 12/1981 | George | 15/160 X |
| 4,319,851 | 3/1982 | Arthur | 134/167 C X |

*Primary Examiner*—Chris K. Moore

*Attorney, Agent, or Firm*—Burd, Bartz & Gutenkauf

[57] ABSTRACT

A device for cleaning leaves and other debris from eave troughs and similar gutters by use of water pressure. The device comprises a carrier adapted for engagement with the forward lip of an eave trough. The carrier supports a high-pressure water nozzle which is adapted to be connected to a source of water under pressure. The carrier is propelled manually by means of an elongated handle along the length of the eave trough as the water stream flushes the debris from the trough.

10 Claims, 5 Drawing Figures

GUTTER CLEANER

BACKGROUND OF THE INVENTION

1. Field of the Invention

This invention is directed to a device for cleaning leaves and other debris from eave troughs and similar gutters of houses, garages, and similar buildings. More particularly, the invention is directed to a gutter cleaner utilizing water pressure.

A seasonal chore for most households is the task of removing leaves and similar debris which collect in the eave troughs and similar gutters present on most houses. As the leaves fall from the trees, a portion of them fall on roofs. These tend to be concentrated as a result of rain and wind and accumulate in the eave troughs. In the event of a heavy rainfall, many or most of the leaves may be flushed through the downspouts. However, more generally the downspout becomes clogged and the leaves must be manually removed by someone climbing up to the eaves. The device of the present invention is directed to simplification of gutter cleaning.

2. The Prior Art

Although a number of devices for cleaning gutters from the ground are the subject of patents, so far as is known, none has found commercial acceptance. Tydings U.S. Pat. No. 2,710,616 discloses a gutter cleaner having a wheeled carriage intended to travel along the edge of a rain gutter. The carriage supports a nozzle connected to a water hose. A deflector spaced from the carriage functions to guide the leaves, propelled by water from the nozzle, over the side of the gutter to fall on the ground. The carriage and deflector are linked together and separate handles are provided to propel them along the gutter.

Mizelle U.S. Pat. No. 2,910,711 discloses a gutter cleaner having an elongated hollow handle adapted to be connected to a garden hose for the passage of water to a cleaning head. The cleaning head has a nozzle at one end for flushing leaves and sediment from the gutter and a flexible element at the other end for dislodging particles which are incapable of being removed by water pressure alone. The device is supported in the gutter by a short projecting leg adapted to ride on the bottom of the gutter during normal operation. The cleaner is manipulated manually by means of the hollow water-carrying handle.

Entler U.S. Pat. No. 3,041,655 shows a similar gutter cleaner having an elongated hollow handle adapted to be connected to a garden hose and leading to a scraper-nozzle adapted to rest in and be moved along the bottom of the gutter.

Wilson U.S. Pat. No. 3,751,749 shows a power driven gutter cleaner having a wheeled carriage adapted to ride the outer flange of the gutter and supporting an electric motor which drives a rotary cleaning element to knock loose and drive accumulated refuse from the gutter.

Feiner U.S. Pat. No. 4,121,320 discloses a gutter cleaner having an elongated hollow handle adapted to be connected to a source of air under pressure and leading to an air nozzle adapted to be guided for movement along the gutter.

SUMMARY OF THE INVENTION

The present invention is directed to a device for cleaning leaves and other debris from eave troughs and similar gutters. The device comprises a longitudinally movable carrier adapted for engagement with the forward lip of an eave trough. The carrier includes a horizontal component and first and second vertical components. Guide means, in the form of skids or rollers, are supported by the horizontal component of the carrier and are adapted to engage the top surface of the trough lip. Similar guide means supported by the first vertical component of the carrier are adapted to engage the outer trough wall adjacent to the lip. A handle is connected at its top end to the carrier and extends vertically downward from the carrier where it can be grasped by one at ground level to propel the carrier along the length of the trough. A hose clamping means is pivotally supported by the carrier. One end of a hose adapted for connection to a source of water under pressure is held by the clamping means. A high-pressure water nozzle is adapted to be connected to the hose to extend longitudinally and downwardly relative to the carrier and the trough, and positioned so as to overlie the trough.

BRIEF DESCRIPTION OF THE DRAWINGS

The invention is illustrated by the accompanying drawings in which corresponding parts ae identified by the same numerals and in which:

FIG. 1 is a fragmentary elevation of the side of a building showing the gutter cleaning device in operation;

DETAILED DESCRIPTION OF THE PREFERRED EMBODIMENT

Figure 2:
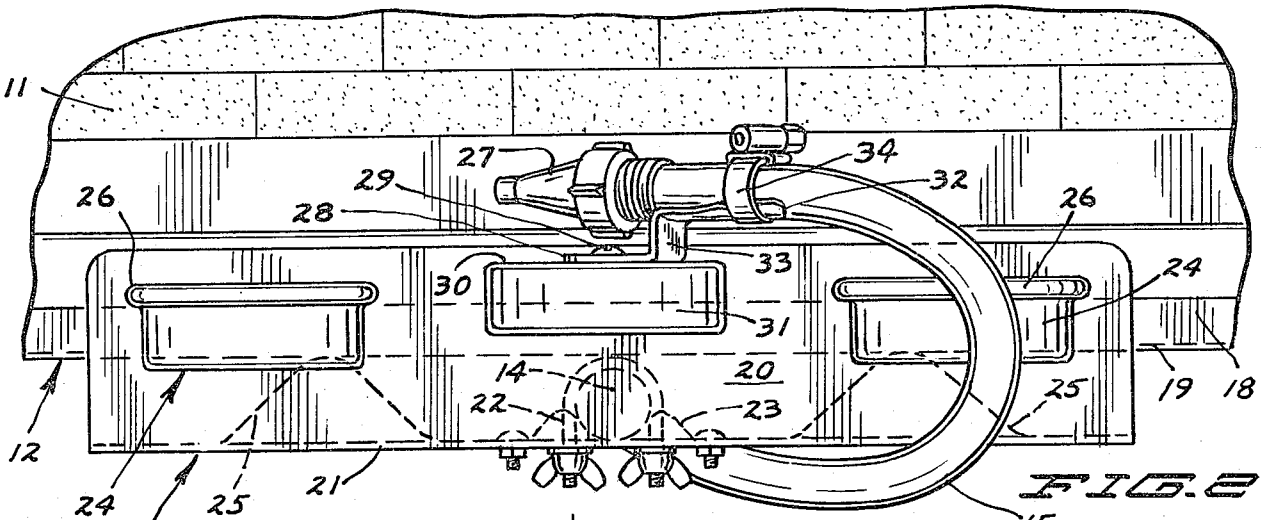
FIG. 2 is a fragmentary top plan view generally on the line 2—2 of FIG. 1 and in the direction of the arrows and on an enlarged scale.

Referring now to the drawings and particularly to FIG. 1, there is shown the wall 10 of a house or similar building having an inclined slope roof 11 along the edge of which is attached an eave trough, indicated generally at 12. The gutter cleaner, indicated generally at 13, is adapted to rest against and be moved along the length of eave trough 12. A long rigid handle 14 is supported from and extends downwardly from the body of the gutter cleaner. Handle 14 is of sufficient length so that it can be grasped by a person on the ground and used to move the cleaner along the trough. A garden hose 15 permits the cleaner to be connected to a source of water under pressure, as explained in detail hereinafter. The hose is preferably attached to the handle by means of ties or clamps 16. Optionally, a mirror 17 may be mounted on the cleaner to permit the operator to observe its operation.

Figure 3:
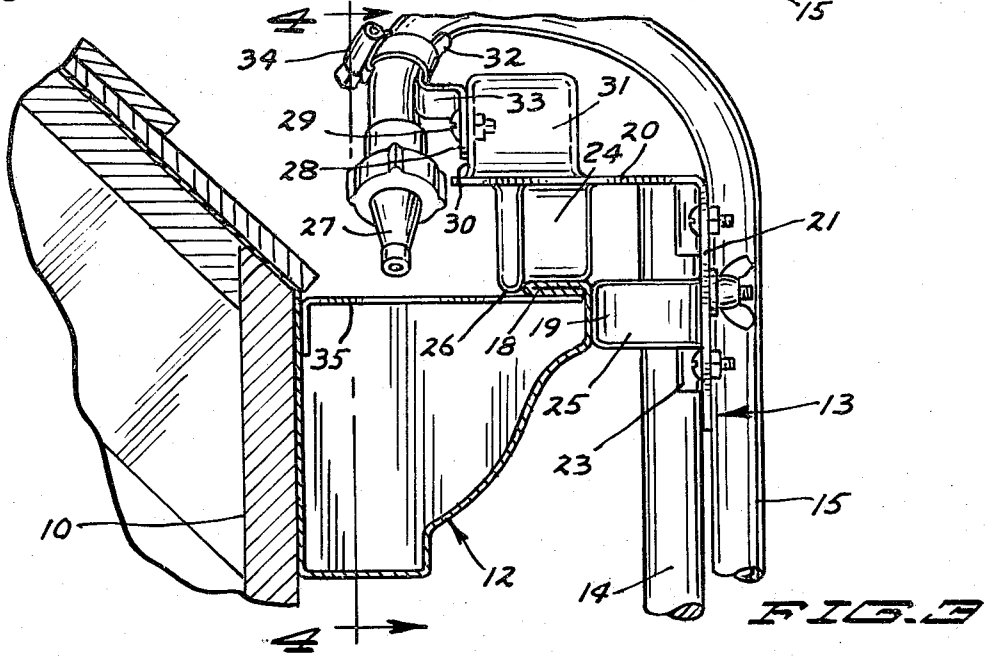
FIG. 3 is a fragmentary vertical left end elevation on an enlarged scale on the line 3—3 of FIG. 1 and in the direction of the arrows.
Figure 7:
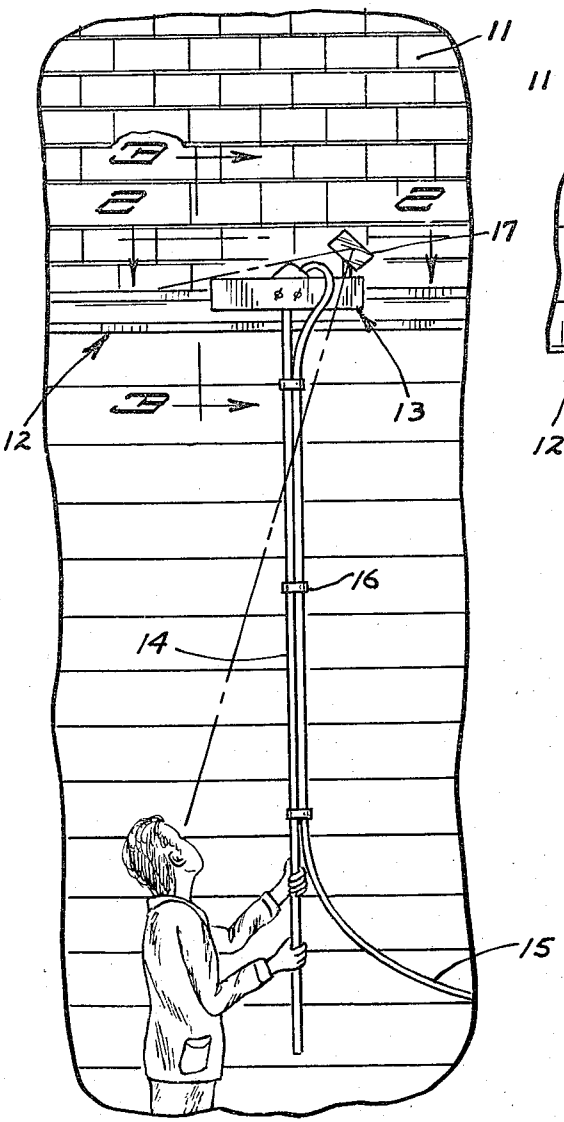
Figure 4:
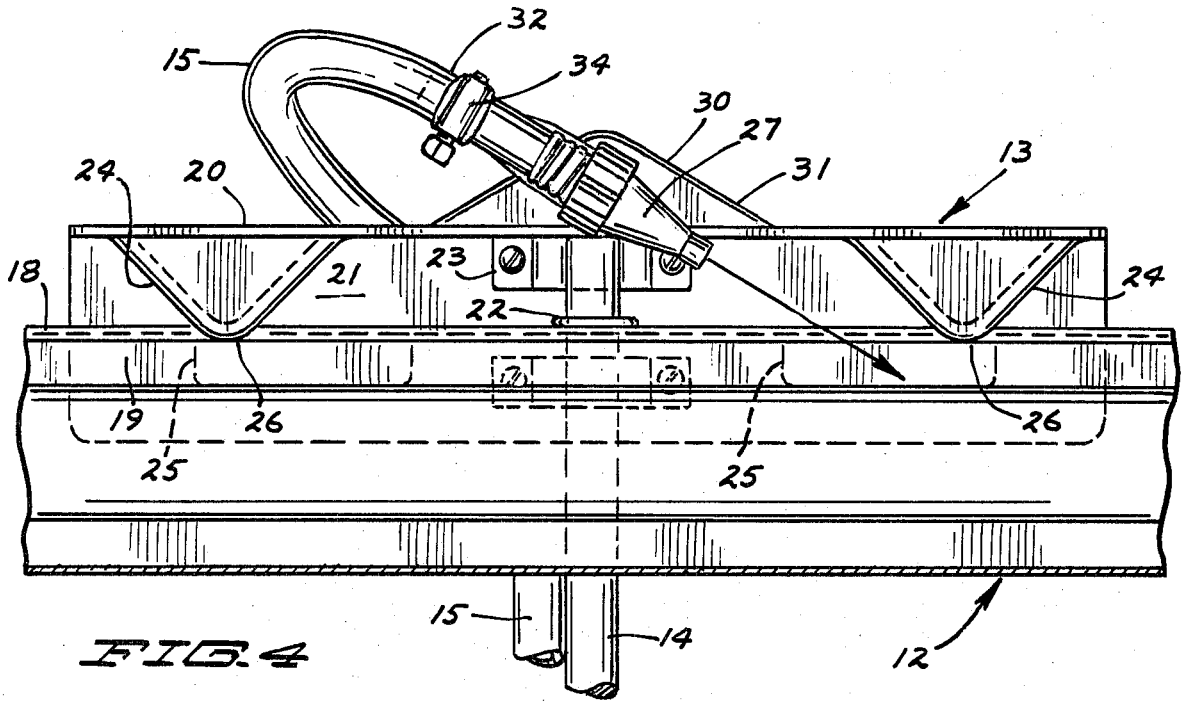
FIG. 4 is a rear elevation generally on the line 4—4 of FIG. 3 and in the direction of the arrows.

The structure of the gutter cleaner is shown in greater detail in FIGS. 2, 3 and 4. Although eave trough are available in a variety of different cross-sectional shapes, they have in common their general open-topped elongated trough or gutter shape whose primary function is to convey rain and melting snow and ice run-off to a downspout for distribution, generally away from the foundation of the building. Eave troughs have in common an inwardly directed forward lip 18 and an immediately adjacent outer trough wall portion 19. As described hereinafter, the gutter cleaner 13 generally is supported on lip 18 and against wall portion 19.

The gutter cleaner 13 includes a longitudinal carrier comprised of a horizontal component 20 in the form of a rectangular sheet metal or molded plastic plate and a first vertical component 21 in the form of a similar sheet metal or molded plastic plate whose top edge is connected to or integral with the edge of plate 20. Desirably plates 20 and 21 may be molded in one piece from rigid synthetic resinous plastic material. Handle 14 is rigidly secured to plate 21 as by means of clamp 22, or equivalent fastening means. The top end of handle 14 is cradled in a pair of vertically spaced apart saddle elements 23 fastened to or formed in vertical plate 21. At least a pair of guide means in the form of longitudinally spaced apart runners in the form of dimple-like skids or glides 24 are secured to or formed in the bottom surface of horizontal carrier plate 20. At least a pair of similar guide means in the form of skids or glides 25 are secured to or formed in the inside or back side of vertical plate 21. Skids 24 and 25 are so positioned that skids 24 are spaced inwardly from vertical plate 21 and skids 25 are spaced downwardly from horizontal plate 20 so that the peripheral edges of skids 24 engage the top surface of trough lip 18 and the peripheral edges of skids 25 engage the adjacent outer trough wall portions 19. Thus, it will be seen that the gutter cleaner can be readily propelled by means of handle 14 along the length of each eave trough segment. Preferably each skid or glide 24 is provided with a dependent lip 26 on its edge spaced farthest away from vertical plate 21. Lip 26 engages the inner edge of trough lip 18 to help maintain the carrier on the trough. The troughs are commonly attached by means of spaced apart sheet metal straps. The guide means easily guide the carrier over such straps.

A high pressure water nozzle 27 is connected to the end of the garden hose 15 and is supported from the top of the carrier so as to overlie the eave trough. The end of the garden hose to which the nozzle 27 is attached is held in a pivotable clamping assembly. The clamping assembly comprises a first flat arm element 28 pivotally secured, as by means of a bolt and nut 29, to a second vertical plate or wall component 30 of the carrier. The second vertical wall component 30 extends upwardly from the top surface of horizontal carrier plate 20. Preferably, when the carrier is formed from synthetic resinous plastic material, the vertical plate 30 comprises part of a molded housing 31 extending upwardly from the plate 20 for added strength.

The clamping assembly includes a further longitudinally extending arm portion 32, preferably arcuate in cross section to cradle the hose, and connected to arm 28 by means of a short off-setting bracket or connector 33. The hose is secured to arm 32 of the clamping assembly by means of any conventional hose clamp 34. The hose is mounted, as best seen in FIG. 3, so that the nozzle extends generally downwardly and longitudinally above the top edge of the trough 12 with the tip of the nozzle spaced immediately above the top edge of the trough so as to avoid interference with the spaced apart sheet metal straps 35 by which troughs are commonly attached. The clamping assembly may be rotated about its pivotal fastener 29 so as to point the hose nozzle in either direction. Because vertical plate 21 extends upwardly from the top of the eave trough and horizontal plate 20 extends partially over the open top of the trough, the carrier functions in most instances to effectively protect the operator from splashing water and overflowing debris.

In the normal mode of usage, a handle of appropriate length is secured to the carrier. The nozzle 27 is positioned at the desired angle and in the desired direction. Then, with the nozzle connected to the garden hose, the water is turned on. The gutter cleaner is initially positioned so that the force of the high-pressure nozzle is directed at the top end of the downspot in order to clear any leaves or other debris from the downspout. Then the carrier is propelled along the eave trough away from the downspout so as to loosen leaves and other debris in the trough and force it along the already cleaned portion of the trough into the downspout. The optional mirror 17 may be used to observe the operation and effectiveness of the cleaner.

Figure 5:
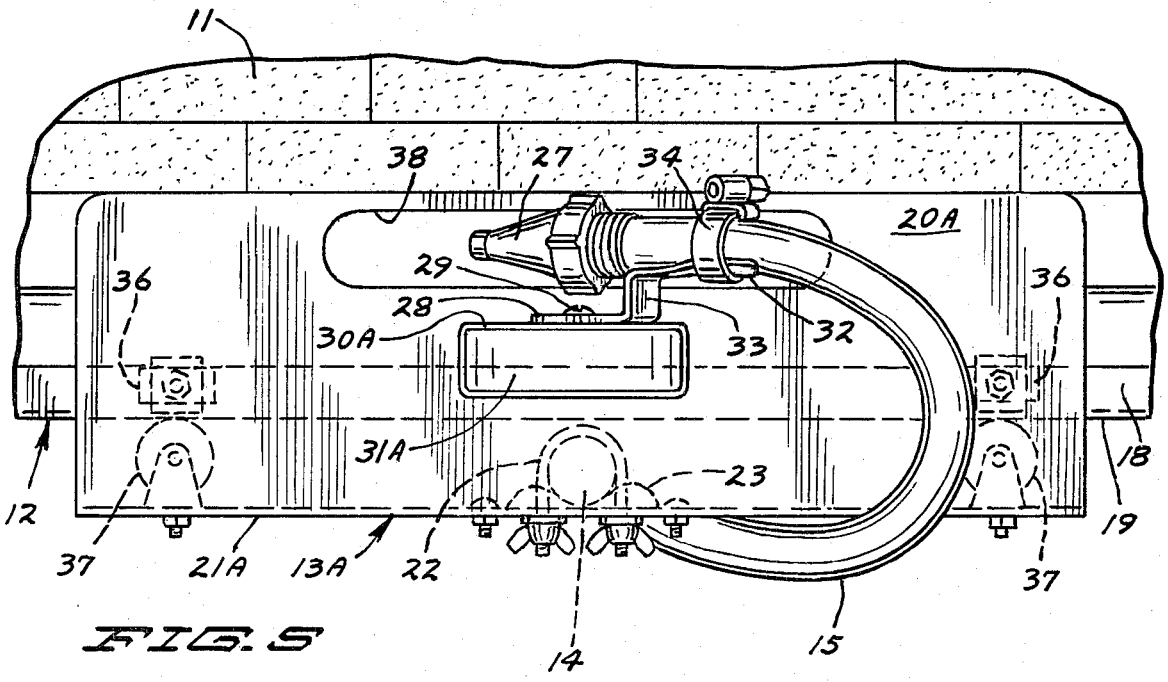
FIG. 5 is a fragmentary top plan view showing an alternative form of guide means and splash plate.

Referring to FIG. 5, there is shown an alternative form of gutter cleaner 13A of similar structure having alternative guide means. Longitudinally spaced apart rollers 36 are secured to the underside horizontal plate 20A. Similar longitudinally spaced rollers 37 are secured to the inside surface of vertical carrier plate 21A. These rollers are so positioned that rollers 36 engage the top surface of trough lip 18, and rollers 37 engage the adjacent outer trough wall surface 19. The rollers then function similarly to skids 24 and 25 to guide the gutter cleaner carrier along the edge of a trough to be cleaned.

The horizontal plate 20A of the alternative form of gutter cleaner is desirably of a width to substantially cover the width of the open top of the eave trough 12. Plate 20A functions as a splash plate to protect the operator from water and debris overflowing from the trough. A slot 38 is provided in the plate for passage of water from nozzle 27. The slot is long enough to permit the nozzle to be positioned to flush in either direction. The hose is clamped to vertical wall 30A of housing 31A in the manner already described.

It is apparent that many modifications and variations of this invention as hereinbefore set forth may be made without departing from the spirit and scope thereof. The specific embodiments described are given by way of example only and the invention is limited only by the terms of the appended claims.

The embodiments of the invention in which an exclusive property or privilege is claimed are defined as follows:

1. A device for cleaning leaves and other debris from eave troughs and similar gutters which comprises:

(A) a longitudinally movable carrier adapted for engagement with the forward lip of an eave trough, said carrier including a horizontal component, a first vertical component extending downwardly from the outer edge of said horizontal component and a second vertical component extending upwardly from the horizontal component, (B) guide means supported by the horizontal component of the carrier adapted to engage the top surface of the trough lip, (C) guide means supported by the first vertical component of the carrier adapted to engage the outer trough wall adjacent to the lip, (D) an elongated handle connected at its top end to said carrier and extending vertically downward therefrom, (E) hose clamping means supported from the inside surface of said second vertical component, and (F) a high pressure water nozzle adapted to be connected to the end of a hose held by said clamping means to extend longitudinally and downwardly relative to said carrier and positioned to overlie the trough.

2. A device according to claim 1 wherein said horizontal and first vertical carrier components are rigid plates joined along a common longitudinal edge.

3. A device according to claim 1 wherein said guide means are skids or runners.

4. A device according to claim 3 wherein at least a pair of skids or runners is supported by each of the horizontal and first vertical components of the carrier.

5. A device according to claim 4 wherein:

(A) said horizontal and first vertical carrier components are rigid plates joined along a common longitudinal edge, and (B) said skids or runners are formed indentations therein.

6. A device according to claim 4 wherein each of said skids or runners supported by the horizontal component of the carrier is provided with a downwardly projecting lip along the edge farthest spaced from the first vertical component.

7. A device according to claim 1 wherein said hose clamping means comprises:

(A) a first arm secured to said second vertical component, (B) a second longitudinally extending arm connected to and laterally off-set from said first arm, and (C) a clamp for securing a hose to said second arm.

8. A device according to claim 1 wherein said hose clamping means is pivotable about a transverse horizontal axis.

9. A device for cleaning leaves and other debris from eave troughs and similar gutters which comprises:

(A) a longitudinally movable carrier adapted for engagement with the forward lip of an eave trough, said carrier including:

(1) a horizontal component, (2) a first vertical component extending downwardly from the outer edge of said horizontal component, said horizontal and first vertical carrier components being rigid plates joined along a common longitudinal edge, and (3) a second rigid vertical component extending upwardly from the horizontal component, (B) at least a pair of skid or runner guide means formed as indentations in the horizontal component of the carrier and adapted to engage the top surface of the trough lip, (C) at least a pair of skid or runner guide means formed as indentations in the first vertical component of the carrier and adapted to engage the outer trough wall adjacent to the lip, (D) an elongated handle connected at its top end to said carrier and extending vertically downward therefrom, (E) hose clamping means supported from the inside surface of said second vertical carrier component and comprising:

(1) afirst arm pivotally secured to said second vertical component for rotation about a transverse horizontal axis, (2) a second longitudinally extending arm connected to and laterally off-set from said first arm, and (3) a clamp for securing a hose to said second arm, and (F) a high pressure water nozzle adapted to be connected to the end of the hose held by said clamping means to extend longitudinally relative to said carrier and positioned to overlie the trough.

10. A device according to claim 9 wherein each of said skids or runners supported by the horizontal component of the carrier is provided with a downwardly projecting lip along the edge farthest spaced from the first vertical component.

* * * * *

UNITED STATES PATENT AND TRADEMARK OFFICE

CERTIFICATE OF CORRECTION

PATENT NO. : 4,363,335

DATED : December 14, 1982

INVENTOR(S) : William R. Tapper

It is certified that error appears in the above-identified patent and that said Letters Patent is hereby corrected as shown below:

Column 2, line 24, "ae" should be --are--.

Column 2, line 61, "trough" should be --troughs--.

Column 4, line 10, "downspot" should be --downspout--.

Column 6, line 23, "afirst" should be --a first--.

Signed and Sealed this

*Twenty-second* Day of *March 1983*

[SEAL]

*Attest:*

GERALD J. MOSSINGHOFF

*Attesting Officer*

*Commissioner of Patents and Trademarks*